US008490632B2

(12) United States Patent
Han

(10) Patent No.: US 8,490,632 B2
(45) Date of Patent: Jul. 23, 2013

(54) ULTRASONIC ARTIFICIAL NAIL REMOVER WITH A NATURAL NAIL SHAPED TIP

(75) Inventor: Kyu Sang Han, Port Washington, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 392 days.

(21) Appl. No.: 12/586,680

(22) Filed: Sep. 25, 2009

(65) Prior Publication Data

US 2011/0073124 A1 Mar. 31, 2011

(51) Int. Cl.
*A45D 29/05* (2006.01)

(52) U.S. Cl.
USPC ..... 132/73.6

(58) Field of Classification Search
USPC ..... 132/73, 73.5, 73.6, 74.5, 75, 75.3, 132/75.4, 75.6, 75.8, 76.4, 285; 433/86, 118, 433/119; 128/200.16; 451/165, 910; 604/22; 606/169, 171, 177, 178
See application file for complete search history.

(56) References Cited

U.S. PATENT DOCUMENTS

| | | | | | |
|---|---|---|---|---|---|
| 1,553,756 | A | * | 9/1925 | Dienner | 132/73 |
| D141,113 | S | | 5/1945 | Gardner | |
| 2,410,420 | A | * | 11/1946 | Bennett | 15/236.01 |
| 2,615,453 | A | | 10/1952 | Ohman | |
| 3,332,150 | A | * | 7/1967 | Mumaw | 433/24 |
| 3,972,122 | A | * | 8/1976 | Sutter | 433/118 |
| 4,248,660 | A | | 2/1981 | Johnson | |
| 4,381,604 | A | | 5/1983 | Horst | |
| 4,836,858 | A | | 6/1989 | Reinhart | |
| 5,151,030 | A | * | 9/1992 | Comeaux | 433/118 |
| 5,320,532 | A | * | 6/1994 | Farzin-Nia et al. | 433/215 |
| 5,749,877 | A | | 5/1998 | Young | |
| 5,755,239 | A | | 5/1998 | Baltierra | |
| 5,947,131 | A | | 9/1999 | Kim | |
| 6,035,858 | A | | 3/2000 | Park | |
| 6,536,065 | B2 | | 3/2003 | Forrest | |
| 6,758,220 | B2 | * | 7/2004 | Willis | 132/200 |
| 7,137,396 | B2 | | 11/2006 | Okane | |
| 7,172,420 | B2 | | 2/2007 | Huguenin et al. | |
| 2002/0156493 | A1 | | 10/2002 | Houser et al. | |
| 2008/0041404 | A1 | | 2/2008 | Vo | |

* cited by examiner

*Primary Examiner* — Todd Manahan
*Assistant Examiner* — Brianne Kalach
(74) *Attorney, Agent, or Firm* — The Farrell Law Firm, P.C.

(57) ABSTRACT

An ultrasonic wave energy artificial nail remover in one aspect includes a handle, a body attached to the handle, an ultrasonic sound wave generator attached to the body, and a tip having the shape of a natural nail. The tip is made to vibrate by the ultrasonic sound wave generator. The shape of the tip allows for a quicker removal of the artificial nail and requires less skill to successfully remove an artificial nail without damaging the natural nail than removal with a narrow flat tip allows and requires. Ultrasonic energy is channeled through the natural nail shaped tip to facilitate removal of an artificial nail in a quick manner with little cleanup involved.

14 Claims, 7 Drawing Sheets

ULTRASONIC ARTIFICIAL NAIL REMOVER WITH A NATURAL NAIL SHAPED TIP

BACKGROUND OF THE INVENTION

1. Field of the Invention

This invention relates to devices for removing artificial nails by ultrasonic means.

2. The Prior Art

Removing an artificial nail can be hazardous as care must be taken to avoid damaging the natural nail beneath the attached artificial nail. The fixture of an artificial nail to a natural nail needs a high degree of strength so as not to be ripped off by accident throughout the course of a day. This strong attachment to the natural nail can provide difficulty when the artificial nail is sought to be removed. As some users regularly switch the artificial nail to wear a different style or color, a need exists for a tool that can provide sufficient power to break down the strong barrier between the artificial nail and the natural nail and to direct that strong power to a small area across the width and length of the natural nail.

It is known to transmit ultrasonic wave energy to a liquid solution, such as acetone, for the purpose of removing artificial nails from a user's nails placed in the solution. See for example U.S. Pat. No. 6,035,858 to Park and U.S. Pat. No. 5,947,131 to Kim.

Additionally, tools have been produced that use ultrasonic energy to produce waves and energy for cleaning or scraping. U.S. Pat. No. 6,536,065 to Forrest discloses an ultrasonic brush nail cleaner. U.S. Pat. No. 7,172,420 to Huguenin et al. discloses an ultrasonic shaping instrument that can be used to scrape tartar from teeth. Ultrasonic tooth brushes are available to consumers for purchase.

A need exists for a tool that can channel ultrasonic wave energy to a uniquely shaped area like a natural nail, so that the strong connection or seal between an artificial nail and a natural nail can be broken down without damaging the natural human nail or surrounding finger. Additionally, a need exists for a tool that can channel ultrasonic wave energy to the unique shape of a natural nail without taking up as much space as an ultrasonic bath in a vessel and with less preparation and cleanup than required for an ultrasonic bath in a vessel.

SUMMARY OF THE INVENTION

An artificial nail remover is provided that is able to channel ultrasonic wave energy through a tip having a natural nail shape to the area on a natural nail where an artificial nail is attached to the natural nail. The remover may be hand operated and in one aspect has a handle, a body attached to the handle, an ultrasonic sound wave generator attached to the body, and a tip having a natural nail shape attached to the ultrasonic sound wave generator. According to this arrangement the tip is made to vibrate by the ultrasonic sound wave generator.

In another aspect, an artificial nail remover is provided having a mount structure, at least one piezoelectric transducer connected to the mount structure, and a tip having the shape of a natural nail attached to piezoelectric transducer or transducers. The remover has at least one electronic driving module that is connected to the mount structure, and at least one link coupling the piezoelectric transducer or transducers to the electronic driving module modules.

In another aspect, an artificial nail remover has a mount structure, a sonotrode attached to the mount structure, a tip having a human nail shape fixed to the sonotrode, and a control unit for controlling and powering the sonotrode including a power circuit and a control circuit for driving the power circuit.

In another aspect, a method for removing an artificial nail from a natural nail includes the steps of providing a handheld artificial nail remover having an ultrasonic sound wave generator coupled to a natural nail-shaped tip. The natural nail-shaped tip is positioned at an interface between the artificial nail and the natural nail. The natural nail-shaped tip is vibrated with the ultrasonic sound wave generator and moved along the natural nail until the artificial nail is separated from the natural nail.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, similar reference characters denote similar elements throughout the several views.

DETAILED DESCRIPTION OF THE DRAWINGS

Figure 1:
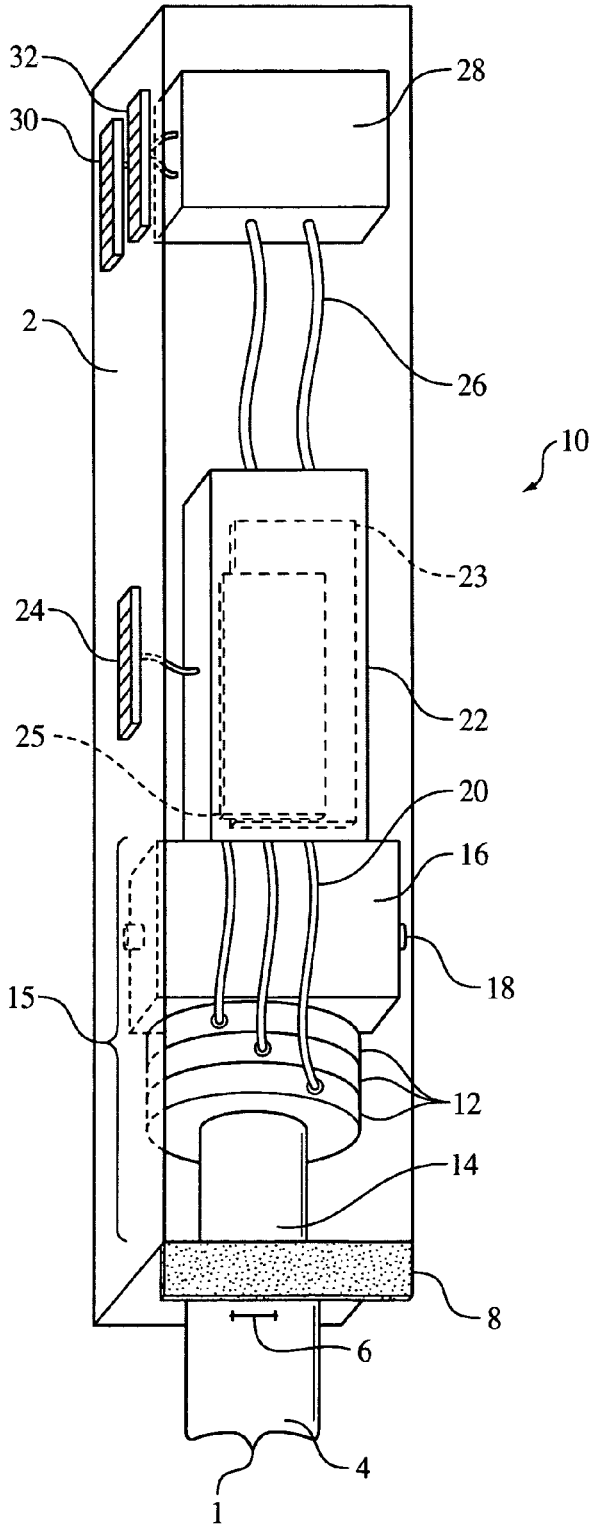
FIG. 1 is a top view of an artificial nail remover according to an embodiment of the invention showing the components thereof including a natural nail shaped tip. A face or cover of the mount structure is removed in this view so that the inner components are visible.

Turning now in detail to the drawings, the artificial nail remover 10 shown in FIG. 1 is an instrument for removing artificial nails from a natural nail, such as, for example a human fingernail or toenail. Artificial nail remover 10 includes a mount structure 2 of non-conductive material that has an inner cavity containing most of the other components of the nail remover 10 including a control unit 22, a sonotrode 15, and a power source 28. A face or cover of the mount structure 2 is removed in this view so that the inner components are visible. Sonotrode 15 shown includes stacked piezoelectric transducers 12, an extension 14 of piezoelectric transducers 12, and an inertial mass 16. The combination of a control unit 22 and a sonotrode 15 can together form an ultrasonic sound wave generator 17 (shown in FIG. 3).

Transducers 12 can be made of piezoelectric material such as those sold, for example, by Philips (Eindhoven NL) under the reference 4322 020 0659. Transducers 12 can be coated on their flat faces with a layer of conductive material that has the function of an electrode. Transducers 12 can be connected in parallel and connected to the power unit by a conductor and by the electrical earth.

Figure 9:
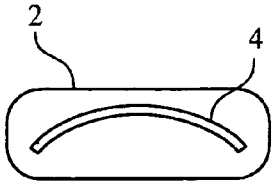
FIG. 9 is an end view of the artificial nail remover shown in FIGS. 7 and 8.

Tip 4 is shaped like an artificial nail worn by a user (i.e. has the shape of a natural nail, such as a human fingernail or toenail) except that tip 4 may include a point 1 as its leading edge where the tip converges. For example, as shown in FIG. 9, tip 4 may have a curved profile which approximates the contour or curvature of the artificial nail and/or natural nail. Tip 4 may be made from a flexible metal material or any other material suitable for removing an artificial nail from a natural nail.

Because tip 4 has the same or similar contour as the artificial nail, when placed underneath the artificial nail worn by the user, the contour will match and facilitate removal of the artificial nail. In a method for removing an artificial nail from a natural nail according to an embodiment of the invention, a handheld artificial nail remover 10 has an ultrasonic sound wave generator 17 coupled to a natural nail-shaped tip 4. The natural nail-shaped tip 4 is positioned at an interface between an artificial nail 40 and a natural nail. The natural nail-shaped tip 4 is vibrated with the ultrasonic sound wave generator 17 and moved along the natural nail until the artificial nail 40 is separated from the natural nail.

Figure 7:
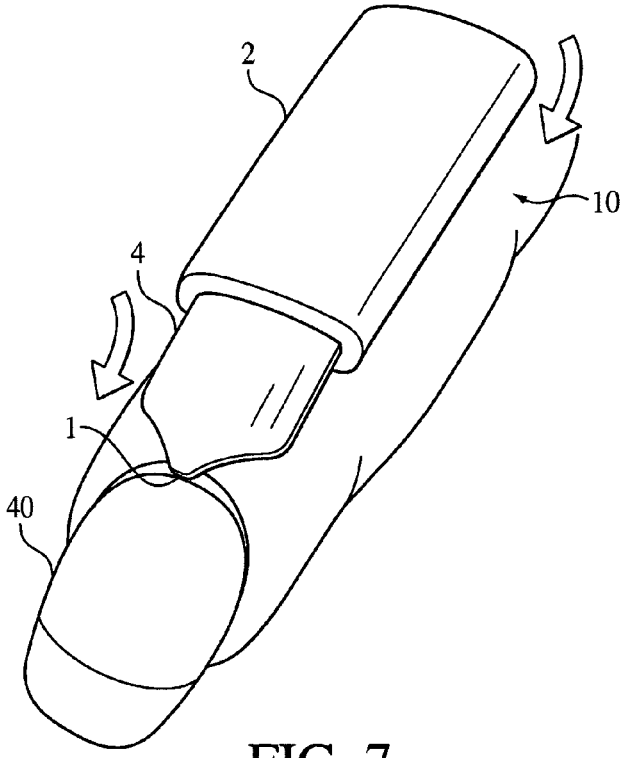
FIG. 7 is a perspective view of an artificial nail remover according to an embodiment of the invention being used to remove an artificial nail from a person's natural nail.
Figure 8:
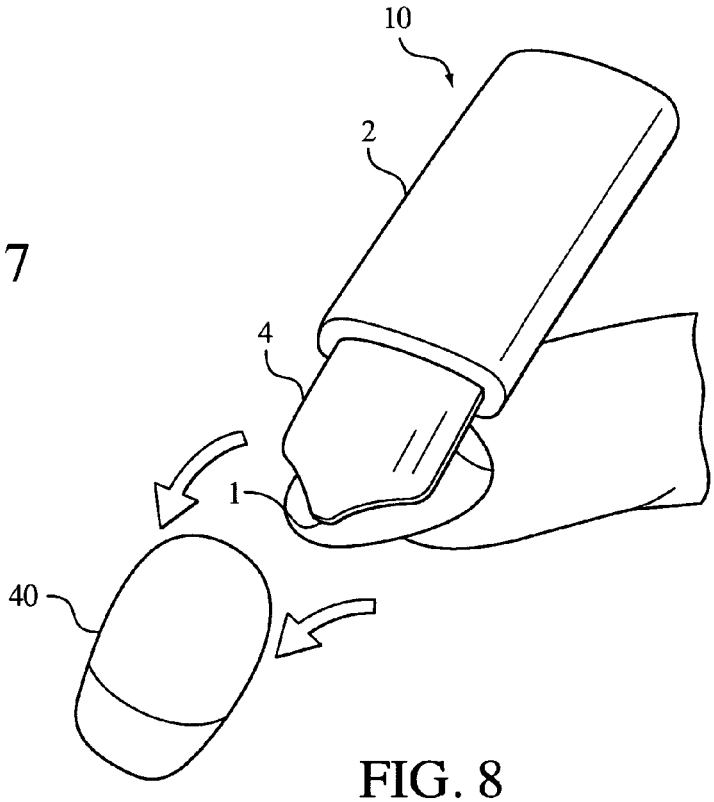
FIG. 8 is a perspective view of the artificial nail remover shown in FIG. 7, wherein the artificial nail has been removed from the natural nail.

As shown in FIGS. 7 and 8, tip 4 may include a sharp pointed portion 1 and a second portion which is more arcuate and rounded than portion 1, such as an arrow-shaped portion. The sharp pointed portion 1 may be used to go under the artificial nail 40, for example at the cuticle area of the natural nail, and the arrow-shaped area of tip 4 which is less sharp (or the area between the arrow shaped area and the point 1) may be used to push the artificial nail 40 off the natural nail once it has been loosened by the point 1.

Figure 2:
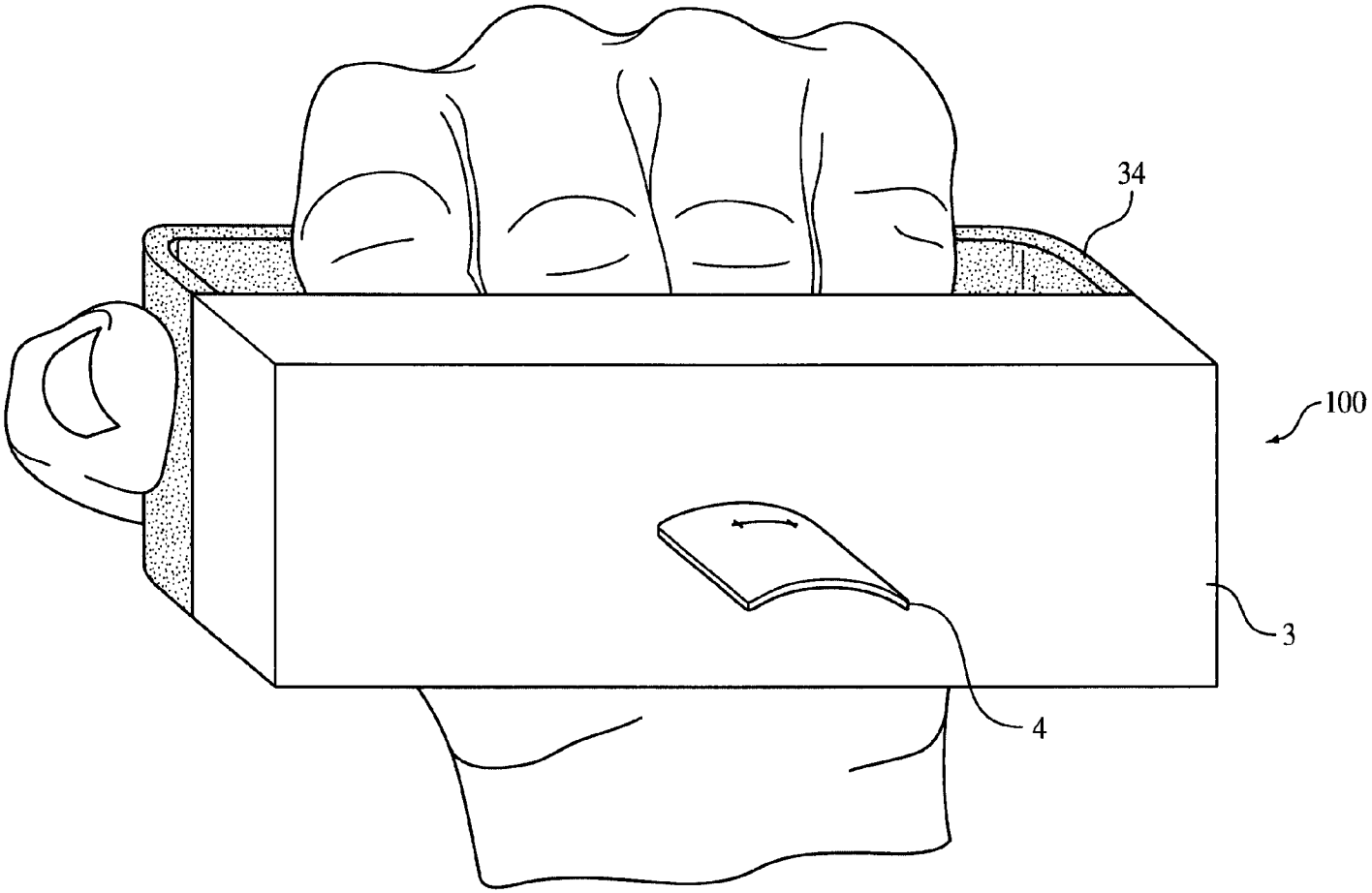
FIG. 2 is a top view of an artificial nail remover according to another embodiment of the invention.
Figure 3:
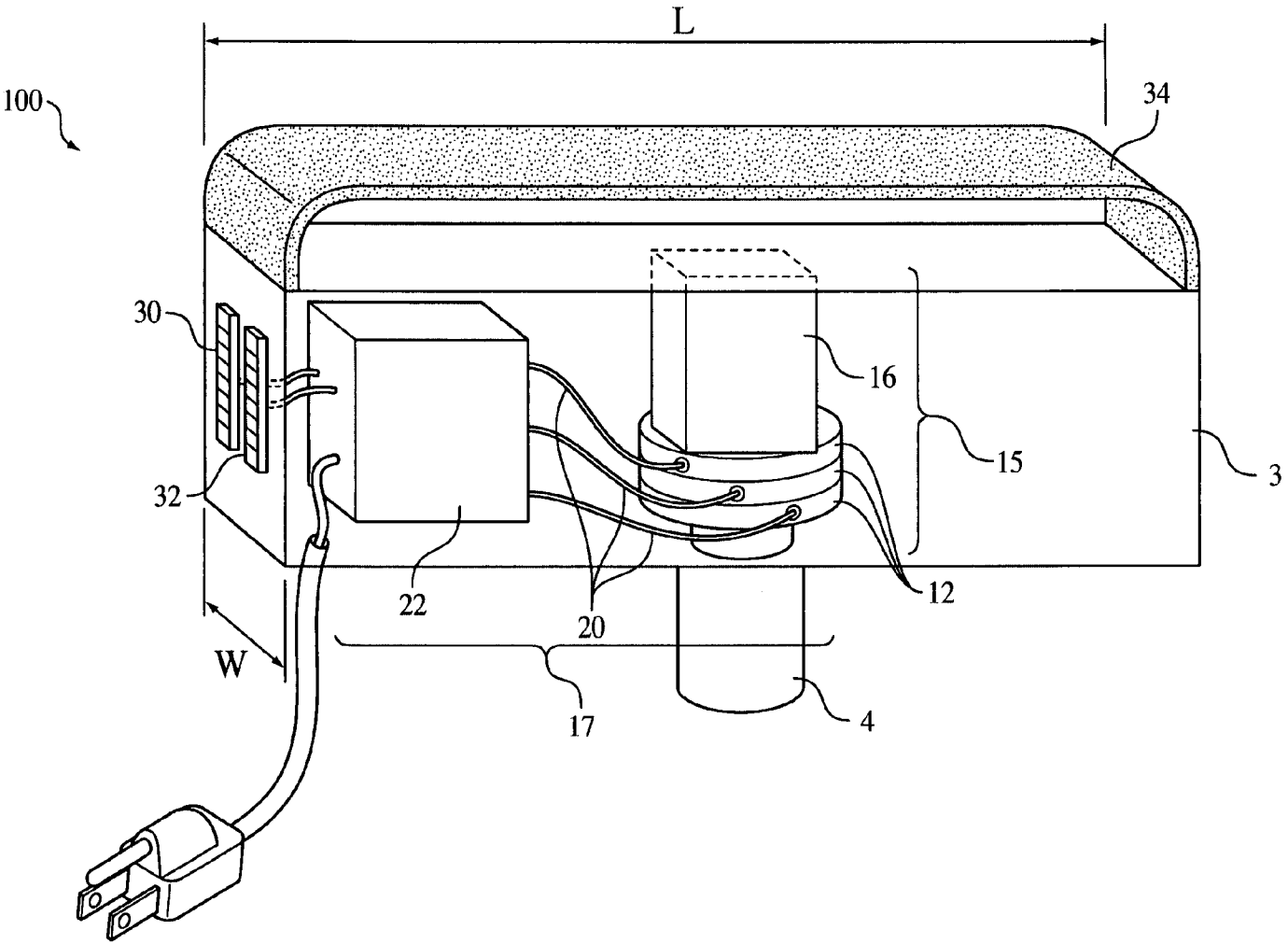
FIG. 3 is a side view of the embodiment shown in FIG. 2 with a face or cover of the body removed so that the inner components are visible.
Figure 6:
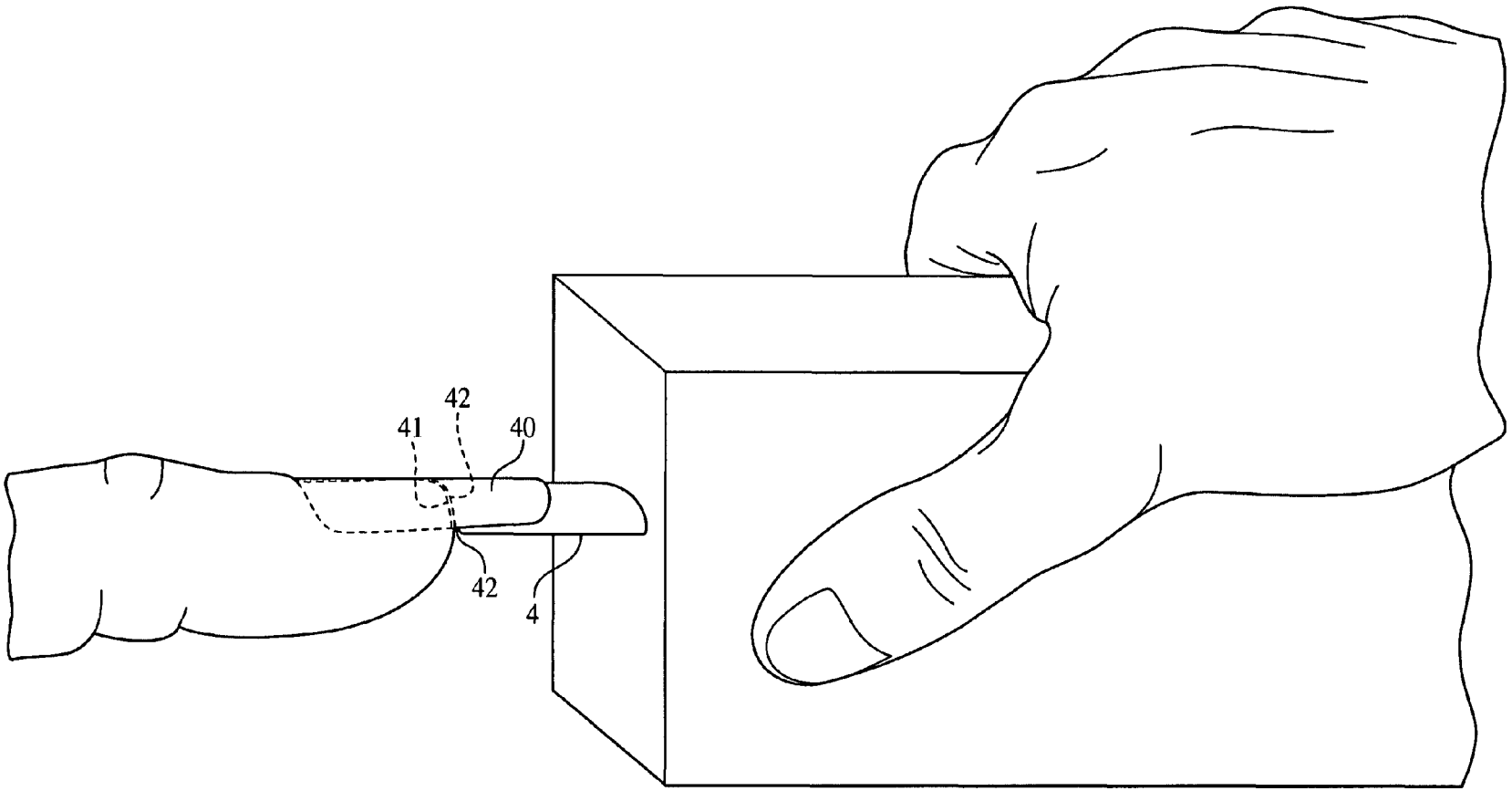
FIG. 6 is a close-up view of an embodiment of the invention being used to remove an artificial nail from a person's natural nail.

The tips 4 shown in FIGS. 2, 3, and 6 are shaped like an artificial nail but do not have a point on the tip where the tip converges. These tips 4 shown in FIGS. 2, 3, and 6 have a width at the transmitting end similar to the width of the end that is connected to the transducers and also that is similar in width to an artificial nail or a natural nail.

Tip 4 is rigidly fixed to the sonotrode extension 14. FIG. 1 shows this connection occurring using clips 6 that protrude from the front side of mount structure 2 underneath tip 4 and up through a slot in tip 4.

It is helpful to tighten the sonotrode mass 16 and transducers 12 so that there is no play between these components. Such tightening will allow a maximum amount of the ultrasonic wave energy to be transmitted to tip 4.

Control unit 22 or electronic driving module 22 is powered by a power source 28 which is shown in FIG. 1 as a battery for providing electric energy. The battery may be rechargeable so that remover 10 could be set in a charger to receive a power charge that would provide enough power to the remover for operation for the time necessary to remove a set of artificial nails. A control unit 22 or electronic driving module 22 includes a power circuit 23 and a control circuit 25 that drives the power circuit. Power circuit 23 and control circuit 25 can be similar to those disclosed in U.S. Pat. No. 7,172,420 to Huguenin et al. at col. 4 lines 54-67 and col. 5 lines 1-35. U.S. Pat. No. 7,172,420 to Huguenin et al. is herein incorporated by reference. Power circuit 23 and control circuit 25 also can be set up like the power supply units, control unit, switching unit and ultrasonic wave oscillator disclosed in U.S. Pat. No. 6,035,858 to Park, for example at col. 5 lines 19-38. U.S. Pat. No. 6,035,858 to Park is herein incorporated by reference.

A user can use his or her thumb to press down on front ledge 8 that extends from the end edge of mount structure 2 for greater support of the nail remover 10 during use. Inertial mass 16 is connected to walls of mount structure 2 at points 18. A helpful size of a mount structure is one similar to the size of a handle of a hairbrush. Links 20 that can be connecting wires send electrical current from control unit 22 to piezoelectric transducers 12. Transducers 12 convert the energy of a DC current supplied by power source 28 to an ultrasonic mechanical sound wave to be transmitted from tip 4. As each piezoelectric transducer crystal resonates, expands, and contracts volumetrically in tune with the frequency supplied by the electronic driving module, the electronic energy is converted into sound wave energy. In this way, tip 4 transmits the sound wave energy through vibrations to the natural nail to break down a connection or seal between the natural nail and an artificial nail.

Links 26 send electrical power from power source 28 to control unit 22 and can also send control signals from a frequency controller 30 provided in body 2. Frequency controller 30 allows the operator of artificial nail remover 10 to increase or decrease the frequency at which artificial nail remover 10 operates. Switch 32 can turn power on or off for artificial nail remover 10. Switch 24 turns the transmission of ultrasonic waves from tip 4 on and off. In the embodiment shown in FIG. 1, power can be flowing from the power source to the control unit although the tip is not transmitting energy in the case where switch 32 is turned on and the other switch 24 is turned off. Artificial nail remover 10 can be wired so that switch 32 controls both the sending of energy from the power source to the control unit and the sending of current from the control unit to the transducers. If power switch 32 or switches 24 and 32 are located on the handle away from tip 4, the vibrating tip 4 does not accidentally turn switch 32 or switches 24 and 32 off during use.

The frequency of the ultrasonic wave generator will generally exceed 20 kHz and can approach the frequencies used in some toothbrushes that use ultrasonic wave generation. Ultrasonic transducers employed in toothbrushes, such as the Ultreo toothbrush produced by Ultreo, Inc. in the state of Washington, can transduce sound of ultrasonic frequencies within the range of about 20 kHz to even 10 MHz; but more typically, from about 20 kHz to about 750 kHz. The term ultrasonic refers to sound of a frequency that is above the audible range of the human ear which is generally above 20 kHZ.

FIG. 2 shows an alternative embodiment of an artificial nail remover. Artificial nail remover 100 has an additional solid handle 34 of non-conductive material protruding from the body 3 of the nail remover and has the natural nail shaped tip 4 protruding from a side surface of the artificial nail remover instead of the end surface as shown in FIG. 1. FIG. 2 shows artificial nail remover 100 being hand-held by an operator. As shown in FIG. 3, the control unit 22 or electronic driving module 22 can be located towards an end of remover 100 and the sonotrode 15 comprising inertial mass 16 and transducers 12 can be located in the middle of the remover 100. Links 20 send current at a certain frequency to transducers 12 where the current is converted into mechanical ultrasonic sound waves. A frequency controller 30 is located on the side of body 3 next to a switch 32 that accomplishes both functions of turning the power of the remover on or off and turning the DC current conversion to ultrasonic energy on or off, in contrast to the embodiment shown in FIG. 1, where these two functions are performed with two separate switches.

FIG. 3 shows the remover in a setup in which power is supplied by a cord which extends to an electrical outlet. An inertial mass 16 also sits behind the piezoelectric transducers 12 in the direction opposite to the direction from which the ultrasonic energy is intended to be transmitted. The remover shown in FIG. 3 has a face or cover of the body of the nail remover removed so that the inner components are visible. An inertial mass such as the one indicated by reference numeral 16 in FIG. 3 is difficult to move and helps the waves produced by the transducers 12 to be transmitted to tip 4 and not in other directions. The transducers 12 are stacked tightly in the inertial mass so that there is no play at a time when the system is not in operation.

The handle 34, body 3 and/or mount structure 2 of artificial nail remover 10, 100 may have a wide horizontal expanse in order to facilitate its gripping. For example, handle 34, body 3 and/or mount structure 2 may have a horizontal expanse of approximately two to six inches, the horizontal expanse being defined as the dimension substantially perpendicular to the direction in which tip 4 extends outwardly from the artificial nail remover 10, 100.

In the embodiment shown in FIG. 3, body 3 and handle 34 have a uniform length L and a uniform width W. Preferably length L of body 3 and handle 34 of the artificial nail remover is greater than width W of body 3 and handle 34 of the artificial nail remover.

It is also possible for the length of body 3 to be different from the length of handle 34 and for the width of body 3 to be different from the width of handle 34. Preferably, the length of body 3 is greater than its width and the length of handle 34 is greater than its width.

Figure 4:
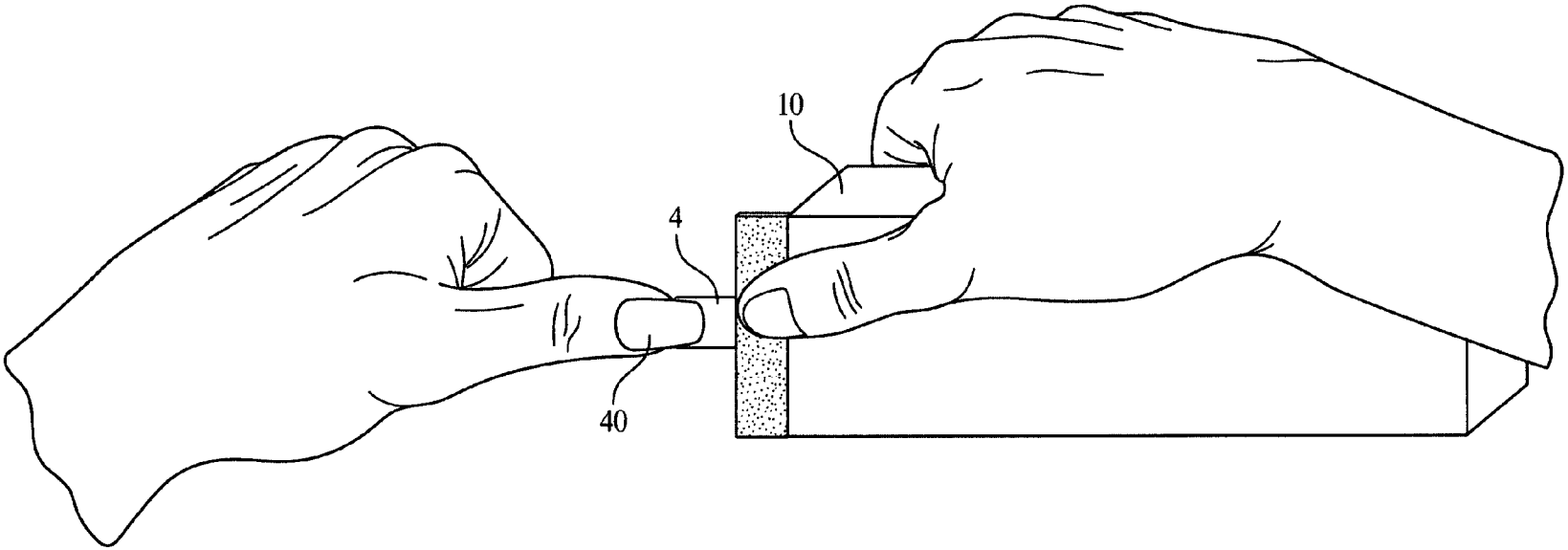
FIG. 4 is a top view of the embodiment shown in FIG. 1 being used to remove an artificial nail from a person's natural nail.

FIG. 4 shows the embodiment shown in FIG. 1 being used to remove an artificial nail 40 from a person's natural nail. In use, tip 4 extends underneath the artificial nail 40 to the area where the artificial nail 40 is connected to the natural nail and where the artificial nail 40 begins to protrude from the end of the natural nail. According to a typical use, the ultrasonic energy transmitted by tip 4 will loosen the bond between artificial nail 40 and the natural nail first at this end of the natural nail. After the bond in this area has been loosened, the operator of the artificial nail remover 10 would move the artificial nail remover 10 progressively closer to the natural nail, finger, and hand, with tip 4 still being underneath the artificial nail, to loosen the bond in areas on the natural nail closer to the cuticle.

Figure 5:
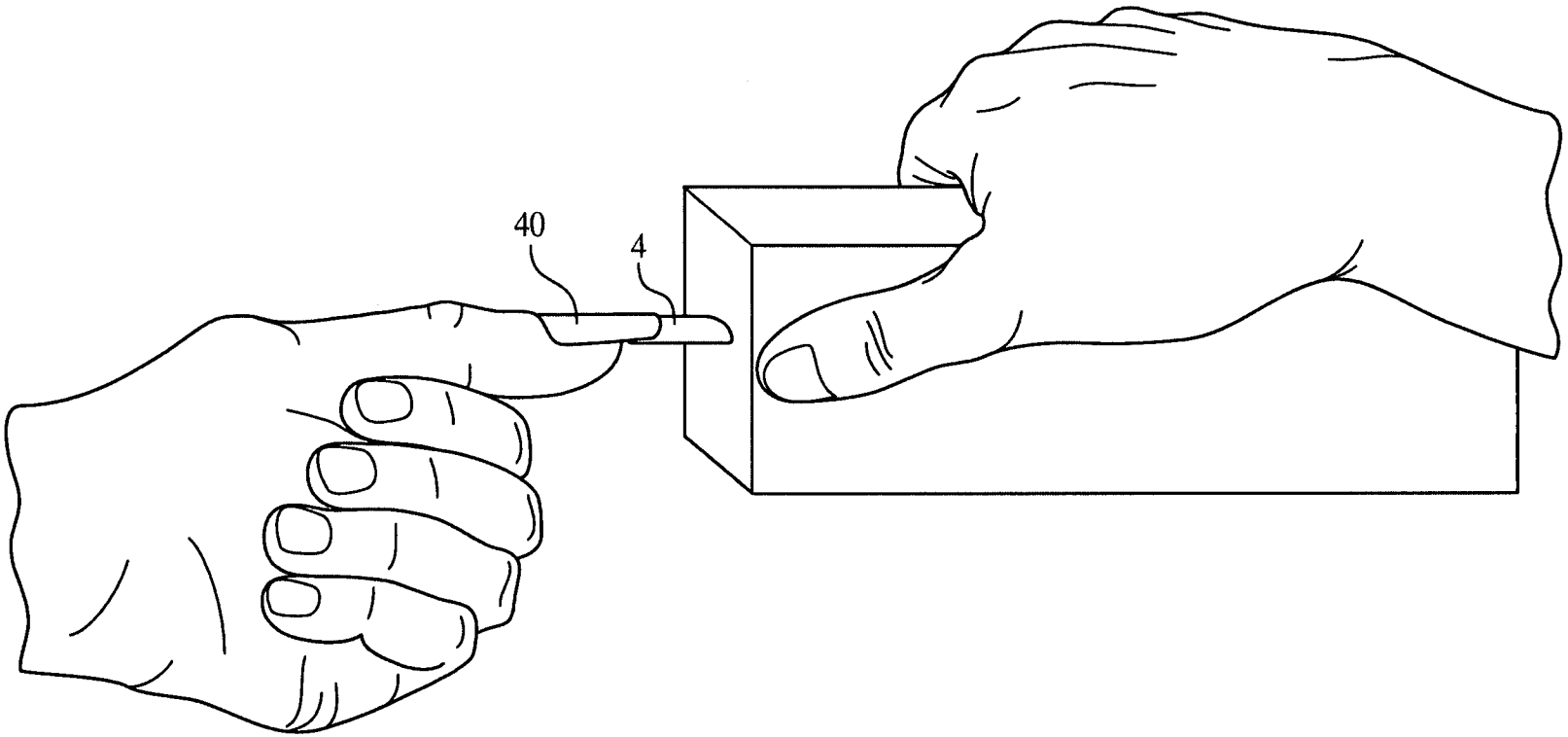
FIG. 5 is a side view of an embodiment similar to the embodiment shown in FIG. 1 being used to remove an artificial nail from a person's natural nail.

FIG. 5 is a side view of an embodiment, similar to the embodiment shown in FIG. 1, with a tip 4 being used to remove an artificial nail 40 from a person's natural nail.

FIG. 6 is a close-up view of an embodiment with a tip 4 being used to remove an artificial nail 40 from a person's natural nail. The tip 4 in this embodiment does not have a point where the tip converges. Dotted lines 41 represent the end of the natural nail underneath artificial nail 40. Dotted lines 42 and solid lines 42 represent the end of tip 4. The width of the end of tip 4 and the contour of tip 4, that matches the contour of the natural nail and the contour of the artificial nail 40, allow the nail remover to transmit energy across the entire width of the natural nail at one time.

FIGS. 7 and 8 show a perspective view of an artificial nail remover 10 according to an embodiment of the invention being used to remove an artificial nail 40 from a natural nail. The artificial nail remover shown in FIGS. 7 and 8 may be similar to the embodiment shown in FIGS. 1 and 4-6 and described herein and may include some or all of the component and features shown and described for the embodiments shown in FIGS. 1 and 4-6.

As shown in FIGS. 7 and 8, an artificial nail remover 10 according to an embodiment of the invention may be used in a manner wherein the device is moved from a rear portion of the artificial nail 40, adjacent the cuticle area, towards the front tip of the natural nail. The arrows in FIGS. 7 and 8 illustrate the exemplary motion of the artificial nail remover 10 as the artificial nail 40 is being removed. The technique shown in FIGS. 7 and 8 differs from that shown in FIGS. 4-6, wherein the device is moved in a direction from a front tip of the nail toward the cuticle portion of the nail. It is noted, however, that the invention is not limited to the movement of the artificial nail remover in any particular direction and that each of the embodiments described may be used in one or both of the directions shown in FIGS. 4-8.

As shown in FIGS. 7 and 8, the point 1 or leading edge of tip 4 may be positioned under the artificial nail 40 at a cuticle portion of the natural nail to which the artificial nail 40 is secured. Preferably, tip 4 is positioned at an interface between the artificial nail 40 and the natural nail. An arrow-shaped portion of the tip 4, which may be more arcuate and rounded than point 1, is used to push the artificial nail 40 off the natural nail once it has been loosened by point 1 by moving the artificial nail remover 10 and vibrating tip toward the tip of the natural nail as indicated by the arrows.

FIG. 9 shows a front end view of the artificial nail remover 10 shown in FIGS. 7 and 8, illustrating the curvature of the natural nail-shaped tip 4.

The tip 4 having the shape of a natural nail can be changed to a tip of a different size to account for users with nails of varying widths.

A tip having the shape of a natural nail allows for a quicker removal of the seal between the artificial nail and natural nail than a tip that is only narrow allows. A narrow tip requires side to side movement which is not required with the natural nail-shaped tip. Additionally, a tip having the shape of a natural nail and having the curvature of a natural nail with a high point at the center axis of the nail and the low points on the side ends of the nail, requires less judgment and skill during operation than a flat tip requires. The natural nail shaped tip with a longer width will mostly require movements parallel to the plane of the hand for the removal of an artificial nail. A flat tip would require judgment by the user during operation to raise or lower the tip as the tip is moved from side to side on the natural nail.

Although only a few embodiments of the present invention have been shown and described, it is to be understood that many changes and modifications may be made thereunto without departing from the spirit and scope of the invention as defined in the appended claims.

What is claimed is:

1. An artificial nail remover comprising:

a handle;

a body attached to said handle;

an ultrasonic sound wave generator disposed in said body;

a frequency controller disposed on a surface of the body for changing a frequency at which the artificial nail remover operates; and a tip having a natural nail shape rigidly fixed to said ultrasonic sound wave generator and protruding from the surface of said body, said tip being made to vibrate by said ultrasonic sound wave generator, wherein said tip comprises an upper convex surface and a lower concave surface opposed to the upper convex surface and said tip converges at a point.

2. The artificial nail remover according to claim 1, wherein said ultrasonic generator operates at the frequency of between 20 kHz and 750 kHz.

3. The artificial nail remover according to claim 1, wherein said body and said handle have a uniform length and a uniform width, said uniform length being greater than said uniform width.

4. An artificial nail remover comprising:

a mount structure;

at least one electronic driving module connected to and disposed in said mount structure;

at least one piezoelectric transducer connected to and disposed in said mount structure;

a frequency controller disposed on a surface of the mount structure for changing a frequency at which the artificial nail remover operates; a switch disposed on a surface of the mount structure for powering the transmission of ultrasonic waves to the tip;

a tip having a natural nail shape rigidly fixed to said at least one piezoelectric transducer and protruding from the surface of said mount structure; and at least one link coupling said at least one piezoelectric transducer to said at least one electronic driving module, wherein said tip comprises an upper convex surface and a lower concave surface opposed to the upper convex surface and said tip converges at a point.

5. The artificial nail remover according to claim 4, further comprising a current on-off switch for controlling a flow of current from said at least one electronic driving module to said at least one piezoelectric transducer, and a power on-off switch for controlling a flow of power from a power source to said at least one electronic driving module.

6. The artificial nail remover according to claim 4, further comprising an on-off switch for controlling both a flow of current from said at least one electronic driving module to said at least one piezoelectric transducer and a flow of power from a power source to said at least one electronic driving module.

7. The artificial nail remover according to claim 4, wherein the artificial nail remover operates at the frequency of between 20 kHz and 750 kHz.

8. The artificial nail remover according to claim 4, wherein a ratio of a width of said mount structure to a width of said tip is in a range of from 1.5:1 to 3:1.

9. The artificial nail remover according to claim 4, wherein a length of said mount structure is greater than a width of said mount structure.

10. An artificial nail remover comprising:

a mount structure;

a sonotrode connected to and disposed in said mount structure;

a tip having a natural nail shape rigidly fixed to said sonotrode and protruding from a surface of said mount structure;

a frequency controller disposed on the surface of the mount structure for changing a frequency at which the artificial nail remover operates; and a control unit for controlling and powering said sonotrode, said control unit comprising a power circuit and a control circuit with a switch for driving said power circuit, wherein said tip comprises an upper convex surface and a lower concave surface opposed to the upper convex surface and said tip converges at a point.

11. The artificial nail remover according to claim 10, wherein the artificial nail remover operates at the frequency of between 20 kHz and 750 kHz.

12. The artificial nail remover according to claim 10, wherein a ratio of a width of said mount structure to a width of said tip is in a range of from 1.5:1 to 3:1.

13. The artificial nail remover according to claim 10, wherein a length of said mount structure is greater than a width of said mount structure.

14. A method for removing an artificial nail from a natural nail, the method comprising the steps of:

providing a handheld artificial nail remover having an ultrasonic sound wave generator rigidly fixed to a natural nail-shaped tip, wherein said tip protrudes from a surface of said handheld artificial nail remover; and a switch disposed on a surface of said handheld artificial nail remover for powering the transmission of ultrasonic waves to the tip;

positioning the natural nail-shaped tip at an interface between the artificial nail and the natural nail;

changing a frequency at which the handheld artificial nail remover operates using a frequency controller disposed on the surface of the handheld artificial nail remover;

vibrating the natural nail-shaped tip with the ultrasonic sound wave generator; and moving the natural nail-shaped tip along the natural nail until the artificial nail is separated from the natural nail, wherein said tip comprises an upper convex surface and a lower concave surface opposed to the upper convex surface and said tip converges at a point.

* * * * *